US007073491B2

(12) United States Patent
Yi

(10) Patent No.: US 7,073,491 B2
(45) Date of Patent: Jul. 11, 2006

(54) EXHAUST GAS RECIRCULATION (EGR) SYSTEM

(75) Inventor: Jea Woong Yi, Hwansung-si (KR)

(73) Assignee: Hyundai Motor Company, Seoul (KR)

( * ) Notice: Subject to any disclaimer, the term of this patent is extended or adjusted under 35 U.S.C. 154(b) by 0 days.

(21) Appl. No.: 11/010,009

(22) Filed: Dec. 10, 2004

(65) Prior Publication Data

US 2005/0235972 A1 Oct. 27, 2005

(30) Foreign Application Priority Data

Apr. 20, 2004 (KR) ..... 10-2004-0027132

(51) Int. Cl.
*F02B 47/08* (2006.01)
*F02B 47/00* (2006.01)

(52) U.S. Cl. ..... 123/568.12; 123/41.31

(58) Field of Classification Search ..... 123/568.11, 123/568.12, 41.31, 184.61
See application file for complete search history.

(56) References Cited

U.S. PATENT DOCUMENTS 6,311,678 B1 * 11/2001 Lepoutre ..... 123/568.12
2005/0039730 A1 * 2/2005 Nishida et al. ..... 123/568.17

FOREIGN PATENT DOCUMENTS

JP 2002-339809 11/2002

* cited by examiner

*Primary Examiner*—Mahmoud Gimie
(74) *Attorney, Agent, or Firm*—Morgan Lewis & Bockius LLP

(57) ABSTRACT

An EGR system has an EGR distributor in the form of a single plate integrally equipped with an exhaust gas passage and a coolant passage for recirculated exhaust gas therewith. The lengths of each exhaust gas passages for the recirculated exhaust gas to reach each cylinder are equal to each other, whereby the amount of the exhaust gas recirculated to each intake passage is same and the overall efficiency of the EGR system is improved. The EGR distributor is preferably manufactured in the form of a single component by AL die casting method.

19 Claims, 5 Drawing Sheets

EXHAUST GAS RECIRCULATION (EGR) SYSTEM

CROSS-REFERENCE TO RELATED APPLICATION(S)

This application claims priority to Korean Application No. 10-2004-0027132, filed on Apr. 20, 2004, the disclosure of which is incorporated fully herein by reference.

Technical Field of the Invention

Generally, the present invention relates to a distributor of recirculated exhaust gas to cylinders of a combustion engine employing an Exhaust Gas Recirculation EGR system. More particularly, the distributor is in the form of a single plate integrally equipped with a delivering means and a cooling means for recirculated exhaust gas thereon.

BACKGROUND OF THE INVENTION

Typically, in order to control emissions of nitrogen oxides (NOx), recent automobiles are furnished with an EGR. The typical EGR system recirculates a part of the exhaust gas into an intake line so that the combustion temperature at a cylinder of an engine is lowered. For example, Japanese patent publication No. 2003-97369 discloses an intake device comprising an intake manifold in which an EGR passage is integrally formed, whereby increasing the mechanical strength of the intake device. According to another example, Japanese patent publication No. 2003-328864 discloses an EGR device comprising a double layered heat exchanger that is provided with a heating passage at the center thereof and a cooling passage at the outer circumference. According to yet another example, Japanese patent publication No. 2000-291455 discloses an EGR system furnished with cooling fins for cooling the recirculated exhaust gas.

The EGR system according to the prior art typically comprises EGR pipes for recirculating a part of the exhaust gas into an intake manifold, a valve for controlling the recirculated exhaust gas, a cooler, and a distributor disposed in the intake manifold so as to supply the recirculated exhaust gas to each of cylinders, respectively. The cooler serves to decrease the temperature of the recirculated exhaust gas. Typically, the cooler comprises a cylindrical housing, a plurality of pipes installed into the housing, a chamber formed in the housing, and a coolant pipe. Another EGR system employs a plate-type distributor formed by combining two plate members, so that the mechanical complexity is significantly reduced.

However, such EGR systems are disadvantageous in that the cooler results in an increase in the number of components and mechanical complexity of the system. Furthermore, the EGR systems are disadvantageous because the systems require sophisticated work in connecting the coolant pipe to the EGR distributor. Because the recirculated exhaust gas is supplied to the cylinders through a pipe, to which each cylinder is connected in series, the amount of exhaust gas recirculated to each cylinder is not uniformly distributed. Due to the unregulated distribution of the recirculated exhaust gas, the efficiency of the EGR system is lowered.

SUMMARY OF THE INVENTION

A primary object of the present invention is to provide an EGR system having an EGR distributor in the form of a single plate integrally equipped with a delivery means and a cooling means for recirculated exhaust gasses. The EGR system includes a simple structure thereby reducing manufacturing cost involved in furnishing an additional cooling means for the exhaust gasses. Another object of the present invention is to provide an EGR distributor that is a single component manufactured by AL die-casting method, whereby manufacturing cost of the distributor can be significantly reduced.

Another objection of the present invention is to provide an EGR distributor in which the lengths of delivery lines for recirculated exhaust gas to each cylinder are substantially equal with each other, whereby variations in the amount of exhaust gas recirculated to each intake passage can be reduced and the overall efficiency of the EGR system improved.

The EGR system according to the present invention comprises an intake manifold having runners, a flange for securing the intake manifold to a cylinder head, and a EGR distributor installed between the intake manifold and the cylinder head. The distributor is integrally combined with a coolant passage through which coolant for cooling the recirculated exhaust gas flows.

In an embodiment of the present invention, an EGR distributor is formed in a single plate-type, which is provided with a coolant passage formed on the front surface facing an intake manifold, and a exhaust gas passage formed on the back surface facing a cylinder head. The EGR distributor further comprises a plurality of intake passages connecting to each cylinder and an inlet for the recirculated exhaust gas. According to a preferred embodiment, the coolant passage is a groove running around an air inlet of the intake manifold, where both ends are in coolant communication with a coolant passage of a cylinder head.

In a further preferred embodiment, the coolant passage is furnished with at least one coolant chamber for more efficient heat exchange of the recirculated exhaust gasses. In a further preferred embodiment, the exhaust gas passage formed on the back surface of the EGR distributor extends from the inlet of the recirculated exhaust gas to a first divergence, with respect to which the intake passages are symmetrically located. At the first divergence, the exhaust gas passage diverges into two separate passages which further extend to second divergences. The second divergences are located at a substantial middle of the left and right symmetric part, respectively, on the basis of the first divergence. The exhaust gas passages diverged at the second divergences are connected to corresponding intake passages. In a further preferred embodiment, the first divergence and the second divergences are disposed on an imaginary line connecting the centers of intake passages. According to yet a further preferred embodiment, the EGR distributor is manufactured by AL die-casting method.

BRIEF DESCRIPTION OF THE DRAWINGS

The aforementioned aspects and other features of the present invention will be explained in the following detailed description, taken in conjunction with the accompanying drawings, in which.

DETAILED DESCRIPTION OF PREFERRED EMBODIMENTS

Figure 1:
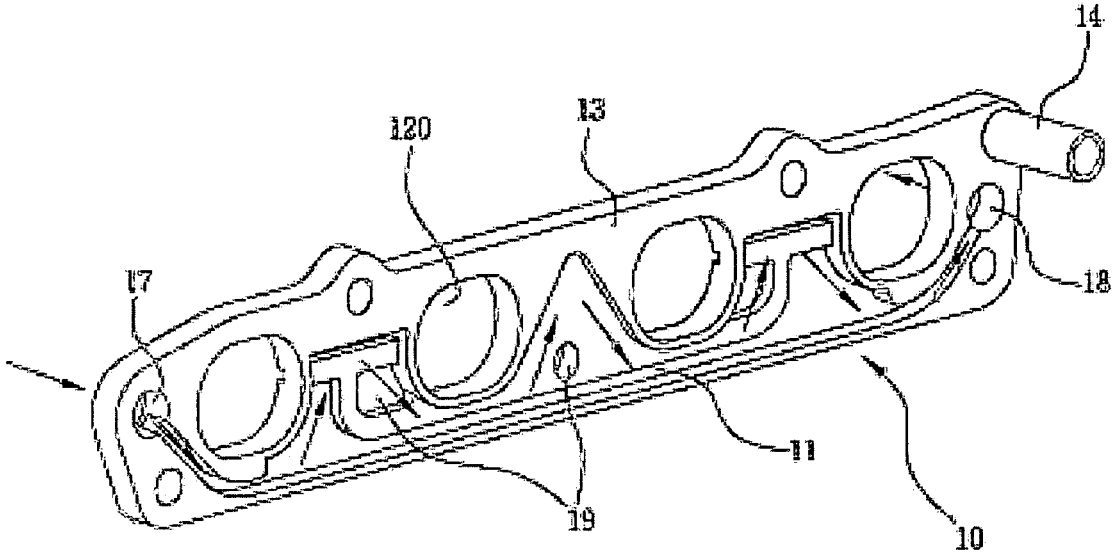
FIG. 1 is a perspective view showing a front surface of an EGR distributor according to an embodiment of the present invention.
Figure 5:
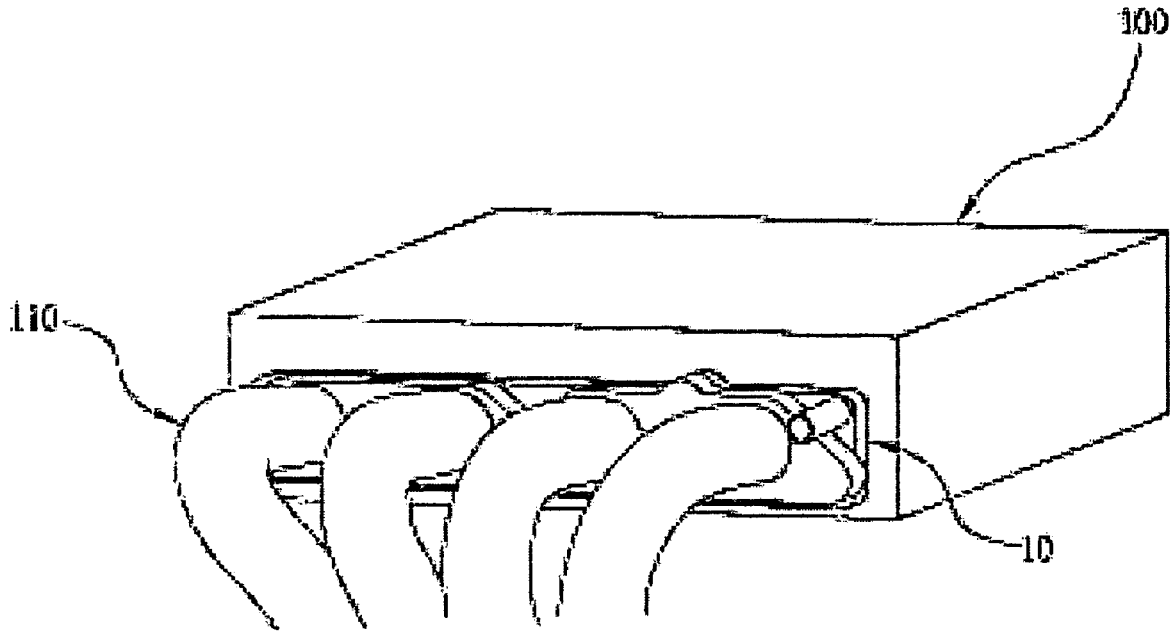
FIG. 5 is a perspective view of an EGR distributor according to an embodiment of the present invention, which is installed between a cylinder head and an intake manifold.

According to FIG. 1, a cooling means is integrated with an EGR distributor 10. An EGR distributor 10 serves to distribute exhaust gas recirculated from an exhaust line to intake passages. The EGR distributor 10 includes an EGR plate 13, which may be in the form of a single plate type or a multi-plate type. Formed in the EGR plate 13 is a plurality of intake passages 120 corresponding to each runner of the intake manifold 110 (FIG. 5). For example, a four-cylinder engine is provided with four intake passages.

The front face of the EGR plate 13 is furnished with a coolant passage 11 in the form of a groove. The coolant passage 11 is in coolant communication with a coolant inlet 17 and a coolant outlet 18, wherein the coolant inlet 17 and the coolant outlet 18 are connected to a coolant passage of a cylinder head. With such an arrangement, coolant is introduced into the coolant passage 11 of the EGR plate from the cylinder head through the coolant inlet 17 and is discharged to the cylinder head through the coolant outlet 18. Namely, the EGR is capable of cooling down recirculated exhaust gas by using coolant circulating within the cylinder head, thereby not requiring an additional cooling device typically employed in conventional EGR systems.

The main stream of coolant passage 11 extends along the edge of the EGR plate 13 in a lateral direction. The coolant passage 11 further comprises at least one coolant chamber formed on the EGR plate 13 and disposed between intake passages 120 so as to enhance the cooling efficiency over the whole EGR plate area. Therefore, the temperature of recirculated exhaust gas is maintained within a desired range.

Figure 2:
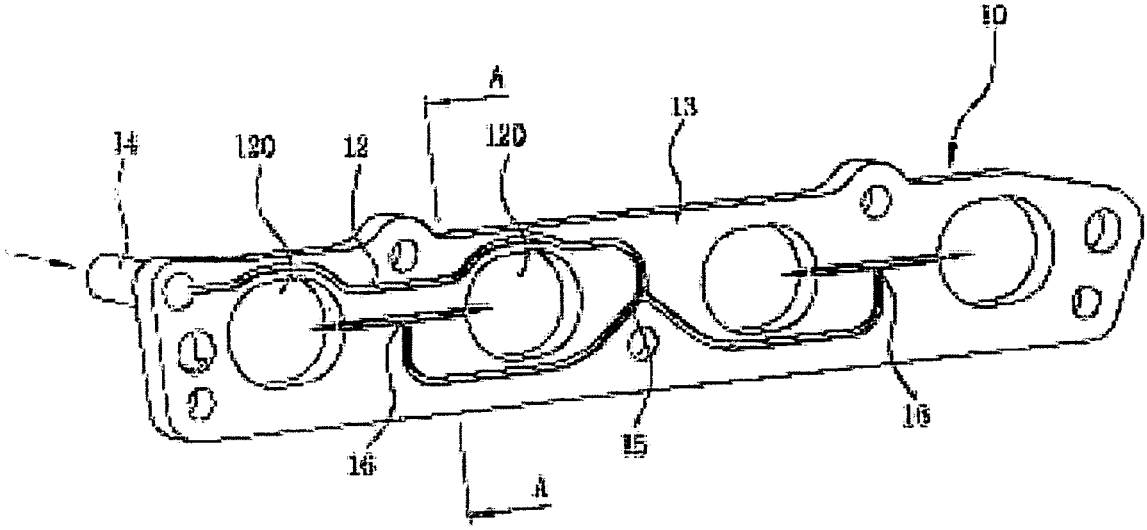
FIG. 2 is a perspective view showing a back surface of an EGR distributor according to an embodiment of the present invention.

FIG. 2 shows a back surface of an EGR distributor 10 according to a preferred embodiment. In FIG. 2, an exhaust gas passage 12 capable of equally delivering the recirculated exhaust gas into each cylinder is well illustrated. An inlet 14 of the recirculated exhaust gas is connected to one end of an EGR pipe and is communicated with the exhaust gas passage 12. The exhaust gas passage 12 extends along the edge of the EGR plate 13 in the lateral direction to a first divergence 15, with respect to which the intake passages 120 are symmetrically located. For example, in case of a four-cylinder engine, the first divergence is positioned between a second intake passage and a third intake passage.

At the first divergence 15 the exhaust gas passage 12 diverges into two separate passages further extending in opposite direction to two second divergences 16 locating at substantially the middle of the left and right symmetric part, respectively on the basis of the first divergence. For example, in case of a four-cylinder engine, the second divergences are positioned between a first intake passage, represented generally as 120, and second intake passage, and between a third intake passage and a fourth intake passage, respectively.

The exhaust gas passages diverged at the second divergences 16 are connected to corresponding intake passages. In light of the delivery of exhaust gas to the intake passages 120, the first divergence 15 and the second divergences 16 are disposed on an imaginary line connecting the centers of intake passages. With such an arrangement, it is possible to reduce a time lag of response of the EGR system because the exhaust gas passages 12 connected to each intake passages 120 have a substantially equal length of path taking the first divergence 15 and the second divergences 16. Furthermore, because the lengths of exhaust gas passages to each intake passages are substantially equal, the variations in the amount of exhaust gas recirculated to each intake passages can be reduced, thereby increasing the overall efficiency of the EGR system.

Figure 3:
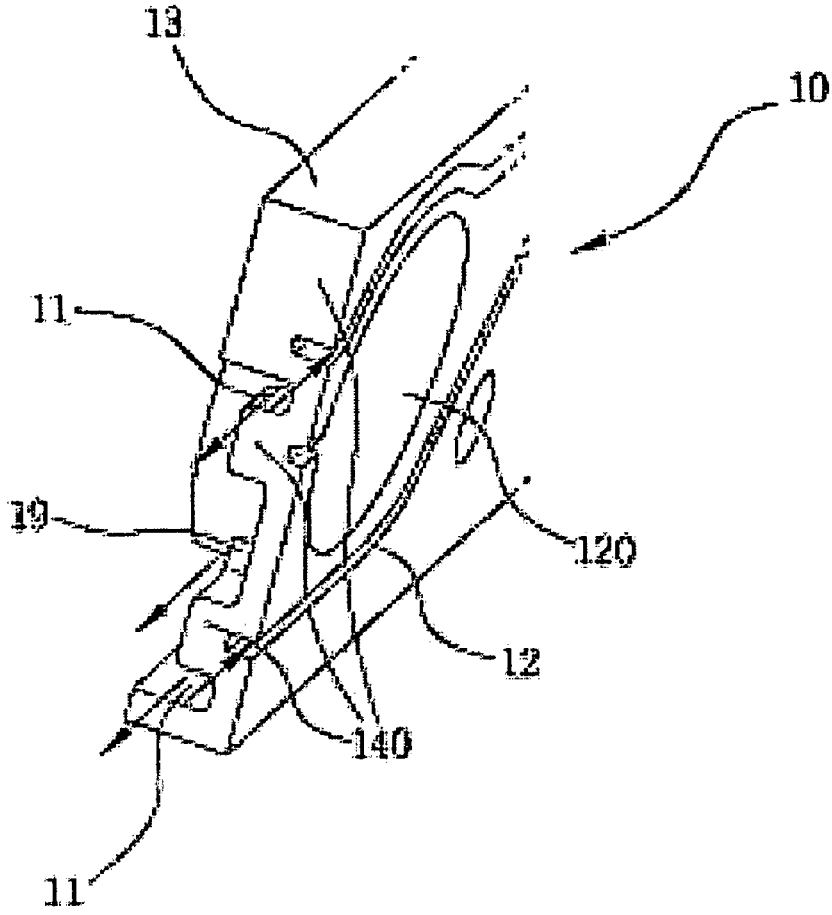
FIG. 3 is a cross-sectional view of an EGR distributor according to an embodiment of the present invention, taken along the line A—A of FIG. 2.

FIG. 3 is a cross-sectional view of an EGR distributor according to an embodiment of the present invention taken along the line A—A of FIG. 2. In FIG. 3, exhaust gas passages 12 and a coolant passage 11 formed around the intake passages are depicted. Formed on the front surface of the EGR plate 13 is a coolant passage 11 of a groove-type and a coolant chamber 19 adjacent to the circumference of the intake passage 120, whereby coolant passes through the coolant passage 11 and the coolant chamber 19 circulating around circumference of the intake passage 120. Formed on the back surface of the EGR plate 13 is an exhaust gas passage 12 of a groove-type, through which the recirculated exhaust gas passes.

On the back surface of the EGR plate 13 the exhaust gas passage 12 is preferably upwardly concaved with a preferred thickness so that the coolant passage and the coolant chamber are accordingly formed. Because the area distributions of the exhaust gas passage 12 and the coolant passage 11 having the coolant chamber substantially adjacent to each other, the efficient of heat exchange between the coolant and the recirculated exhaust gas can be optimized.

Figure 4:
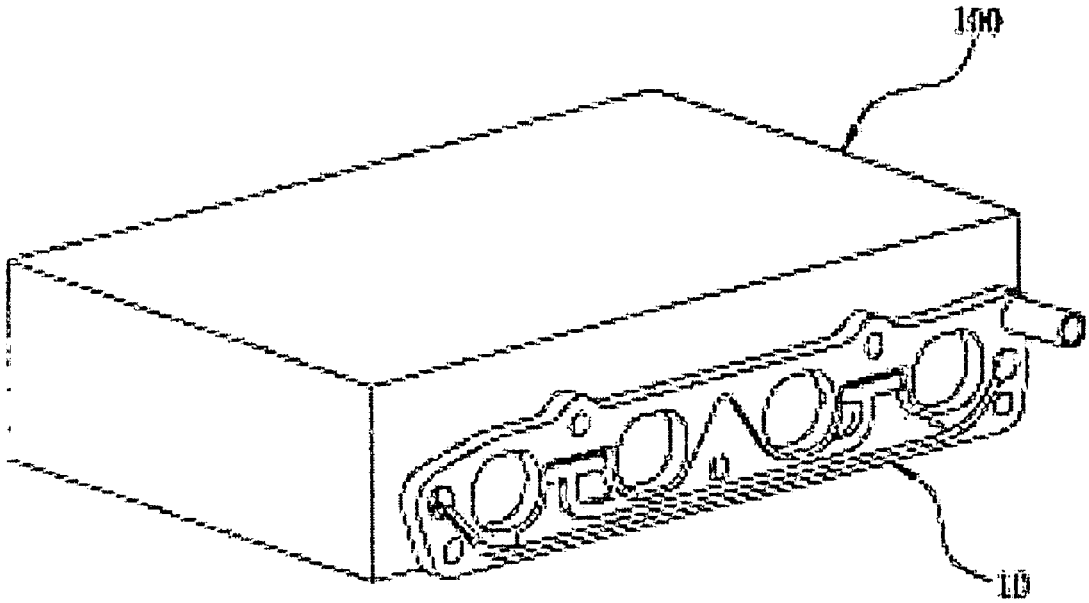
FIG. 4 is a perspective view of an EGR distributor according to an embodiment of the present invention, which is installed to a cylinder head.

FIGS. 4 and 5 show the EGR distributor in an assembled state. As described above, because the EGR distributor 10 is made of a single plate integrally equipped with a coolant passage and an exhaust gas passage on respective sides of the plate, it can be readily manufactured by AL die-casting method, as will be appreciated by one of ordinary skill in the art. The EGR distributor 10 is fabricated with a cylinder head 100 and an intake manifold with runners 110 in such a manner that the front surface of the EGR distributor 10 faces the intake manifold 110 and the back surface of the EGR distributor 10 faces the cylinder head 100.

The EGR distributor 10 is provided with a plurality of holes for fixing it to the cylinder head 100 and a flange 130 of the intake manifold 110. When the EGR distributor 10 is installed between the cylinder head 100 and the intake manifold 110, the intake passage 120 of the EGR distributor is aligned with the intake passages formed in the cylinder head 100 and the intake manifold 110. Simultaneously, the coolant inlet 17 and outlet 18 of the EGR distributor 10 are fit to a coolant passage of the cylinder head 100. Accordingly, the coolant passage 11 and the exhaust gas passage 12 of the EGR distributor 100 in the form of a groove are sealed by the cylinder head 100 and the intake manifold 110, whereby those serve to complete each passage. Furthermore, it is preferable to provide sealing means along the contour of the contact area of the EGR distributor, the cylinder head, and the flange 130 of the intake manifold/runners 110 in order to ensure an air tight coupling.

As described above, the EGR distributor 10 according to the present invention, which is integrally combined with a cooling means and a delivering means exhaust gas, is advantageous in that the complexity of an EGR system can be simplified by eliminating EGR cooler and auxiliary components involved in a cooling means as compared to conventional systems. Moreover, the cost for providing an additional cooling means is saved and the EGR coolant passage is directly connected to the coolant passage of the cylinder without any connecting means such a pipes, and therefore, the labor-intensive work for fabricating the connecting means becomes lessened. Manufacturing cost for the EGR distributor 10 is significantly reduced because the distributor is made of one element by AL die casting method. Also, the variations of the amount of exhaust gas recirculated to each intake passage can be substantially reduced by configuring the exhaust gas passages of each intake passage to be equal in length and dimensions, whereby the overall efficiency of the EGR system is improved.

Even though the present invention is described in detail with reference to the foregoing embodiments, it is not intended to limit the scope of the present invention thereto. It is evident from the foregoing that many variations and modifications may be made by a person having ordinary skill in the present field without departing from the essential concept and scope of the present invention as defined in the appended claims.

What is claimed is:

1. An EGR system, comprising:

a cylinder head;

an intake manifold having runners and a flange integrally formed at the end of the runners for engaging said intake manifold to said cylinder head; and an EGR distributor disposed between said intake manifold and said cylinder head, the EGR distributor having a coolant means formed integrally thereon for cooling EGR, wherein said EGR distributor is provided with at least one EGR plate having a coolant passage formed on the front surface facing said intake manifold and an exhaust gas passage formed on the back surface facing said cylinder head, wherein said coolant passage formed on the front surface of said EGR plate is in coolant communication with a coolant passage of said cylinder head.

2. The EGR system according to claim 1, wherein said EGR plate is formed of a single plate.

3. The EGR system according to claim 1, wherein said exhaust gas passage is upwardly concaved.

4. The EGR system according to claim 1, wherein said coolant passage is provided in the form of a groove.

5. The EGR system according to claim 1, wherein said coolant passage further comprises a coolant chamber.

6. The EGR system according to claim 1, wherein said coolant passage is configured to allow coolant to circulate around said exhaust gas passage of said EGR distributor and said flange.

7. The EGR system according to claim 1, wherein sealing means are provided between the contact area of said coolant passage and said flange, and between the contact area of said exhaust gas passage and said cylinder head, respectively.

8. The EGR system according to claim 1, wherein said EGR distributor is fabricated with said flange between said cylinder head and said intake manifold in such a manner that a front surface of said EGR distributor faces said intake manifold and a back surface of said EGR distributor faces said cylinder head.

9. The EGR system according to claim 1, wherein said exhaust gas passage is provided in the form of a groove, which firstly extends from an inlet to a first divergence located substantially symmetrically between intake passages, said exhaust gas passage thereby diverging into two separate passages extending to two second divergences locating substantially equidistant from said first divergence, respectively, wherein the exhaust gas passages diverged from the second divergences connect to each intake passage.

10. The EGR system according to claim 9, wherein said first divergence and said second divergences are positioned on an imaginary line connecting centers of intake passages.

11. The EGR system according to claim 1, wherein said EGR plate is manufactured by AL die casting method.

12. The EGR system according to claim 9, wherein said EGR plate is manufactured by AL die casting method.

13. An EGR system, comprising:

a cylinder head;

an intake manifold defining intake passages, said intake manifold being configured to couple with said cylinder head; and an EGR distributor configured and dimensioned to be disposed between said intake manifold and said cylinder head, the EGR distributor defining a coolant path for cooling EGR;

wherein said coolant path is in coolant communication with a coolant passage of said cylinder head.

14. The EGR system according to claim 13, wherein said EGR distributor further defines an exhaust gas passage.

15. The EGR system according to claim 13, wherein said EGR distributor is configured from at least one EGR plate.

16. The EGR system according to claim 14, wherein said coolant path is positioned on a side of said EGR distributor configured to couple with said intake manifold and said exhaust gas passage is positioned on a side of said EGR distributor configured to couple with said cylinder head.

17. The EGR system according to claim 14, wherein said coolant path is configured adjacent to said exhaust gas passage of said EGR distributor.

18. The EGR system according to claim 14, wherein said exhaust gas passage is configured as a groove, which firstly extends from an inlet to a first divergence located substantially along a midline between longitudinal ends of the EGR distributor, said exhaust gas passage thereby diverging into two separate passages extending to two second divergences locating substantially equidistant from said first divergence, and wherein the exhaust gas passages diverging from the second divergences open into each intake passage.

19. An EGR plate, comprising:

a plate configured and dimensioned to be disposed between an intake manifold and a cylinder head of an internal combustion engine;

wherein said plate defines:

an exhaust recirculation passage configured substantially within a first surface of said plate, wherein the first surface engages the cylinder head; and a coolant passage configured substantially within a second surface of said plate, wherein the second surface engages the intake manifold;

wherein said coolant passage is in coolant communication with a coolant passage of said cylinder head.

* * * * *